US006444269B1

(12) United States Patent
Innes et al.

(10) Patent No.: US 6,444,269 B1
(45) Date of Patent: Sep. 3, 2002

(54) APPARATUS AND METHOD FOR COATING SHEET OR STRIP ARTICLES

(75) Inventors: Robert A. Innes; David G. Hallam, both of Kingston (CA)

(73) Assignee: Alcan International Limited, Montreal (CA)

( * ) Notice: Subject to any disclaimer, the term of this patent is extended or adjusted under 35 U.S.C. 154(b) by 0 days.

(21) Appl. No.: 09/446,564

(22) PCT Filed: Jun. 26, 1998

(86) PCT No.: PCT/CA98/00611

§ 371 (c)(1),
(2), (4) Date: May 8, 2000

(87) PCT Pub. No.: WO99/00196

PCT Pub. Date: Jan. 7, 1999

Related U.S. Application Data

(60) Provisional application No. 60/051,087, filed on Jun. 27, 1997.

(51) Int. Cl.[7] ..... B05D 3/12; B05C 11/02

(52) U.S. Cl. ..... 427/358; 427/356; 118/123; 118/125; 118/126; 118/410; 118/413; 118/411

(58) Field of Search ..... 427/356, 358; 118/413, 410, 411, 123, 125, 126

(56) References Cited

U.S. PATENT DOCUMENTS

| | | | | |
|---|---|---|---|---|
| 3,690,297 A | | 9/1972 | Dentch et al. | |
| 4,327,130 A | | 4/1982 | Pipkin | |
| 4,345,543 A | | 8/1982 | Pipkin | |
| 4,387,124 A | | 6/1983 | Pipkin | |
| 4,675,230 A | | 6/1987 | Innes | 427/280 |
| 5,067,432 A | | 11/1991 | Lippert | 118/413 |
| 5,147,462 A | | 9/1992 | Wollam | 118/679 |
| 5,882,407 A | * | 3/1999 | Takeno et al. | 118/419 |

FOREIGN PATENT DOCUMENTS

| | | |
|---|---|---|
| WO | 94/27739 | * 12/1994 |
| WO | 96/15858 | * 5/1996 |

OTHER PUBLICATIONS

"Innovations in Coex Flat Dies," Plastics Technology, Technology, Oct. 1992 (2 pp.).

* cited by examiner

*Primary Examiner*—Katherine A. Bareford
(74) *Attorney, Agent, or Firm*—Cooper & Dunham LLP

(57) ABSTRACT

A coating head, and coating apparatus and methods using the coating head, for applying a solvent free coating material to a strip article advancing longitudinally in a coating line. The head includes a die having a transverse slit through which the coating material is deposited on the strip surface and having a land portion with an extended land surface on the exit side of the slit, the die being supported for movement normal to the strip surface, and one or more air or hydraulic cylinders exerting a load on at least the land portion of the die to urge the land surface toward the strip, wherein the die is constituted of a main body and the land portion, and the land portion is so connected to the main die body as to be capable of flexing relative to the main die body in a direction normal to the strip surface but to resist flexing in the direction of strip advance in the coating line.

12 Claims, 8 Drawing Sheets

APPARATUS AND METHOD FOR COATING SHEET OR STRIP ARTICLES

This application is a national stage application of PCT/CA98/00611, filed Jun. 26, 1998, which application claims the priority benefit of U.S. provisional patent application Ser. No. 60/051,087, filed Jun. 27, 1997.

TECHNICAL FIELD

This invention relates to the continuous coating of sheet or strip articles, such as aluminum or other metal strip, hereinafter generically termed "strip articles." In an important sense, it is directed to coating heads especially suitable for applying low solvent or reduced solvent coatings or solvent free coatings, e.g. molten polymers, and to coating lines and methods employing such heads.

BACKGROUND ART

More particularly, the present invention is directed to improvements in the types of strip-coating apparatus and methods described in U.S. Pat. No. 4,675,230 and in International (PCT) Application No. PCT/CA94/00291 published Dec. 8, 1994, under International Publication No. WO 94/27739.

U.S. Pat. No. 4,675,230 describes apparatus and procedure for applying a paint or like coating to an elongated strip article using a coating head with a die that has a slit to which coating material is supplied under pressure and a strip-facing extended surface or metering land immediately downstream of the slit, and a support such as a roll around which the strip is advanced past the head for receiving from the slit a layer of paint metered between the die and the strip, wherein a load is continuously exerted on the die during operation for urging the land against the applied paint layer on the strip so as to maintain a uniform metering gap between the land and the coated strip surface. The load may be exerted by devices such as air cylinders acting on the die and capable of adjustment to vary the magnitude of the load for different coating operations. In this way, a coating of superior uniformity can readily be applied to a surface of an article such as sheet metal strip, notwithstanding that the strip characteristically exhibits some variation in thickness along its length; the maintenance of a load on the coating head die facilitates accuracy and ease of setup, and also enables the die to conform positionally to variations in strip thickness, for maintaining a constant metering orifice aperture. U.S. Pat. No. 5,147,462 describes apparatus for automatic film thickness control in coating procedures and apparatus of the same general type.

The methods and apparatus of U.S. Pat. No. 4,675,230 are shown as arranged for applying a coating to one major surface of a strip article (one-sided coating). The aforementioned PCT publication describes modifications or arrangements of methods and apparatus of this type enabling simultaneous application of coatings to both major surfaces of a moving strip or sheet (two-sided coating). The apparatus arrangements thus described for two-sided coating comprise two coating heads of the general type described in U.S. Pat. No. 4,675,320, mounted face-to-face with the strip passing between them.

In particular, the aforementioned PCT publication discloses apparatus for continuous two-sided coating of a strip article, including means for defining a path of continuous longitudinal advance of an elongated strip article having opposed major surfaces to be coated, the path including a rectilinear portion in which the opposed surfaces of the strip article are substantially planar; two coating heads each including a die defining an elongated open-sided slit and having a land portion with an extended land surface immediately adjacent the exit side of the slit, for respectively depositing layers. of liquid coating material on the opposed major surfaces of a strip article advancing in the path; and means for supplying liquid coating material under pressure to the slit of each head. The apparatus thus disclosed also includes means for supporting the dies of the two heads in facing relation to each other on opposite sides of the rectilinear portion of the strip article path while permitting individual translational movement of at least the land portion of at least one of the dies relative to the supporting means in a direction perpendicular to the major surfaces of a strip article advancing in the path. This supporting means positions the heads such that their die slits respectively open toward the opposed major surfaces of an advancing strip article in the rectilinear path portion with their long dimensions extending transversely of the path; their die land surfaces are disposed, substantially in register with each other, beyond the slits in the direction of strip article advance, respectively facing the opposed major surfaces of an advancing strip article and converging toward each other and toward the path in the direction of article advance; and, during operation with the article advancing past the slits and liquid coating material supplied to both slits as aforesaid, the article major surfaces respectively drag layers of coating material from the slits, the layers being thereby deposited on the article major surfaces. In combination with the foregoing features, the disclosed apparatus further includes means for continuously exerting a load on at least the land portion of the aforementioned one die during operation as aforesaid such that the layers of coating material deposited on the strip major surfaces are pressed between the land surfaces of the dies of the heads to maintain the deposited coating layers at predetermined constant thicknesses while the coating layers alone hold the dies entirely away from contact with the strip article major surfaces.

In some embodiments of the described apparatus, the aforementioned one die comprises a land portion as defined above and a portion that is stationary during operation, the land portion being movable relative to the stationary portion and cooperating therewith to define the slit. The load-exerting means, in these embodiments, acts between the supporting means and the movable land portion of the die. In other embodiments, the aforementioned one die is formed integrally and the load-exerting means acts between the supporting means and the entire die, which is supported on a bearing so as to be capable of moving as a unit relative to the supporting means during operation. The other die (including its land portion) can be held entirely stationary during the coating operation, or, alternatively, the dies of both heads (or their land portions) can be movable relative to the supporting means during operation and can both be acted on by load-exerting means.

In the heads of the aforementioned U.S. Pat. No. 4,675,230 and PCT publication, the load-exerting means for the (or each) die conveniently comprises at least one air cylinder acting thereon. Preferably, the load-exerting means comprises a plurality of air cylinders acting at points spaced along the length of the die, and the die is made sufficiently flexible to conform to variations of strip thickness across the width of the strip, for enhanced coating uniformity.

Heretofore, coating heads for use in the apparatus and methods described in the aforementioned patents and publication have been designed with a relatively small cross-section so that the complete die (including land portion) of the head could be flexed by modest applied forces. To achieve the required degree of flexibility for conforming to strip thickness variations as just described, the overall cross-sectional dimensions of the die should not exceed about four inches (10 cm) and should preferably be less than two inches (5 cm). Slot dies for solvent-borne coatings can readily be designed to meet this requirement. However, for solvent free coatings (solvent free molten polymer coatings), the dies must incorporate heating elements and must have specially designed, polished channels to ensure uniform distribution of the coating. For these reasons, typical polymer extrusion dies have overall cross-sectional dimensions in excess of six inches (15 cm). It would not be possible to control the flexing of a die with these dimensions, without resorting to very high loading forces.

DISCLOSURE OF THE INVENTION

The present invention, in a first aspect, broadly contemplates the provision, in apparatus for continuously coating a major surface of a strip article while the article is advancing longitudinally along a defined path, of a coating head including a die defining an elongated slit, with an entry side and an exit side, for depositing a layer of liquid coating material on a facing major surface of a strip article advancing along the path, and having a land portion with an extended land surface at the slit exit side; means for supplying liquid coating material to the slit; means for supporting the die with the slit and land surface facing the path and the slit extending transversely of the path such that during coating operation a major surface of a strip article advancing in the path past the slit drags a layer of coating material from the slit, the supporting means permitting movement of the die relative thereto in a direction normal to the path and to the slit; and means for continuously exerting a load on at least the land portion of the die during operation as aforesaid such that the layer of coating material deposited on the last-mentioned article major surface is pressed between the land surface and the last-mentioned article major surface to maintain the layer at a predetermined constant thickness while the layer alone holds the die entirely away from contact with the last-mentioned article major surface; the die including a main body defining at least the entry side of the slit, and the land portion being so connected to the main die body as to be capable of flexing relative thereto in the aforesaid normal direction but to resist flexing in the direction of article advance in the path.

It will be understood that, when the die is supported as described above relative to an advancing strip article, the land portion (at the exit side of the slit) extends transversely of the strip article major surface to be coated. In this coating head, the defined connection of the land portion to the main body of the coating head die affords the characteristic flexing properties of the metering portion of a coating head of the type described in U.S. Pat. No. 4,675,230, even though the main body of the die may have the increased bulk and thickness needed to accommodate built-in heating elements for solvent free molten polymer coatings, and may therefore be incapable of flexing. At the same time, the movability of the entire die in the aforesaid normal direction relative to the supporting means enables coarse positional adjustment of the die, so that the tolerances of the head and support components do not have to be as exact as would be necessary if only the land portion were movable.

As further particular features of the invention, the land portion is advantageously formed integrally with the main body of the die, and the load-exerting means exerts the load directly on the land portion. The land portion can be cantilevered with respect to the main die body, or, in currently preferred embodiments of the invention, the land portion can be flexibly connected to the main die body on two opposed sides of the land portion respectively toward and away from the slit (upstream and downstream of the land surface, as stated with reference to the direction of strip advance in the path).

Moreover, in currently preferred embodiments of the coating head of the invention, the load-exerting means comprises a piston movable in the aforesaid normal direction and means connected to the piston for transmitting the load directly to the land portion, the last-mentioned means being interengageable with the main die body for permitting but limiting the extent of motion of the piston and land portion relative to the main body in the aforesaid normal direction. In particular, the land portion may have a second surface opposed to the land surface; the transmitting means may include a chock attached to the piston, a rod for load-transmitting engagement with the second surface of the land portion, and a lateral projection (such as a pin or dovetail protection) carried by the chock; and the main die body may include a socket (recess or aperture) within which the projection is received, the projection and socket being positioned and dimensioned to permit a limited extent of motion of the projection within the socket in the aforesaid normal direction. Also, in these embodiments, the transmitting means can transmit a force from the piston to the main die body for moving (lifting) the die relative to the supporting means in the normal direction.

The invention in a further aspect contemplates the provision of a coating line for continuously coating a major surface of a strip article while the article is advancing longitudinally along a defined path, comprising the combination of a head as described above with means for defining a path and direction of continuous longitudinal advance of a strip article having a major surface to be coated. The coating line. may be arranged to coat one or both major surfaces of a strip article; in a line for coating two opposed surfaces of a strip article, the path includes a rectilinear portion in which the opposed surfaces are substantially planar, the supporting means supports the above-described coating head at that rectilinear portion of said path such that during a coating operation the slit faces one of the opposed major surfaces of a strip article advancing along the path, and a second coating head is disposed at the rectilinear path portion in opposed relation to the first-mentioned coating head, for depositing a layer of liquid coating material on the other of the opposed major surfaces of the strip article.

In yet another aspect, the invention contemplates the provision of a method of continuously applying a layer of liquid coating material to a major surface of an elongated flexible strip article, utilizing a coating line incorporating the above-described coating head of the invention. This method, again, may be used to effect coating of one or both major surfaces of a strip article very advantageously, it can be used to coat one or both major surfaces of a strip article with a solvent free liquid coating material, such as a molten polymer.

Further features and advantages of the invention will be apparent from the detailed description hereinbelow set forth, together with the accompanying drawings.

BEST MODES FOR CARRYING OUT THE INVENTION

For purposes of illustration, the invention will be described as embodied in coating heads, lines and methods for continuously and simultaneously coating both opposed major surfaces of a flexible strip of sheet aluminum metal (the term "aluminum" herein generically designating pure aluminum metal and aluminum-based alloys) with solvent free liquid coating material, viz., molten polymer. In its broader aspects, however, the invention may be used for a wide range of coating operations, substrates, and coating materials, such as for one-sided coating, for coating of strip articles other than aluminum strip or sheet (e.g., aluminum foil, sheet or foil of steel or other metals, paper, plastic sheet or films, etc.), and for applying liquid coating materials other than 100% solids coatings (e.g., low solvent or reduced solvent coatings, or standard coating formulations including lacquers and paints, lubricants, etc.).

Figure 1A:
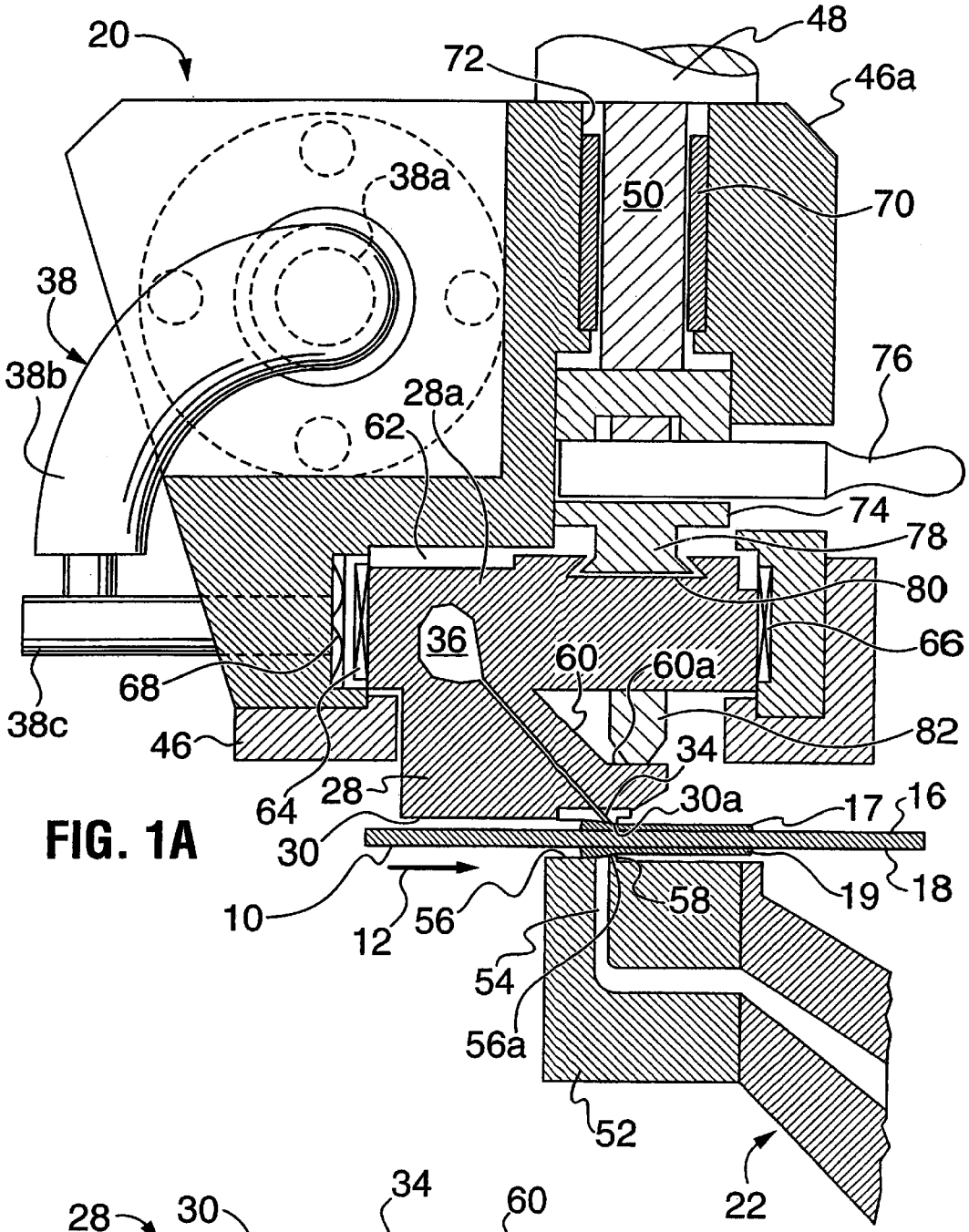
FIG. 1A is a highly simplified and schematic side elevational sectional view of a coating head, and associated elements of a two-sided aluminum strip coating line, embodying the present invention in a particular form.
Figure 1B:
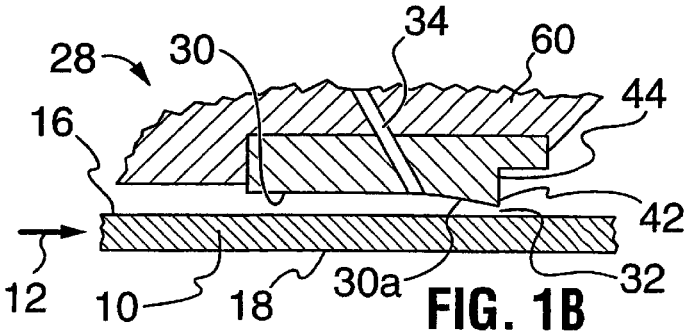
FIG. 1B is an enlarged fragmentary side elevational sectional view of a portion of the FIG. 1A head.
Figure 2:
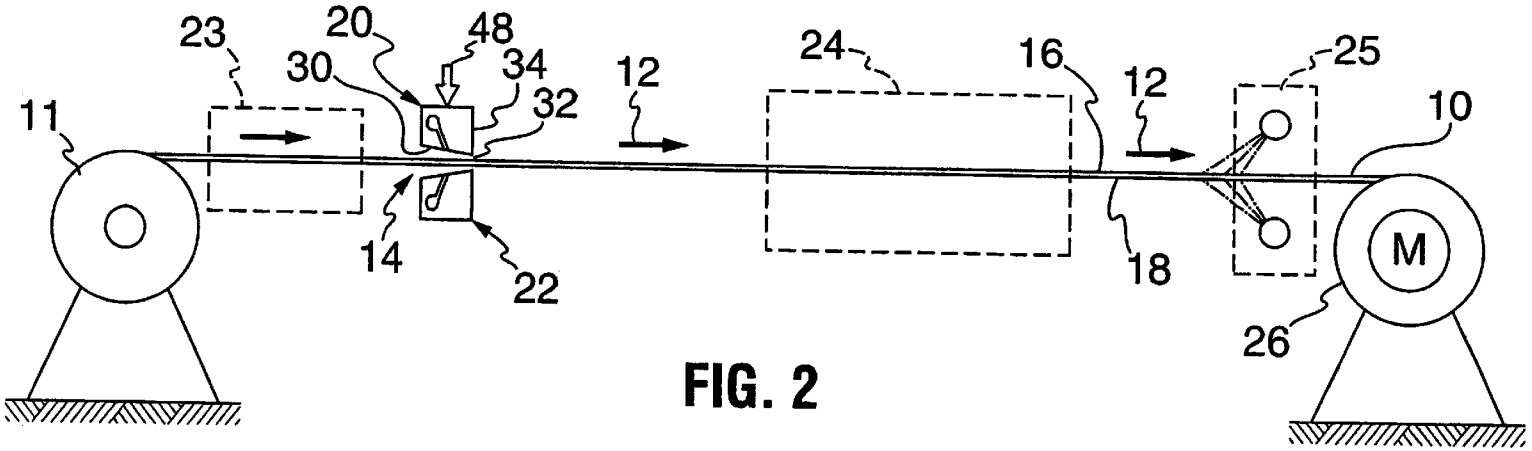
FIG. 2 is a reduced and further simplified schematic side elevational sectional view of a complete two-sided aluminum strip coating line in which the head and other elements of FIG. 1 may be incorporated.

In the coating line schematically shown in FIGS. 1A, 1B and 2, a metal strip article (e.g., sheet aluminum strip) 10 to be coated is continuously advanced, in a direction longitudinally parallel to its long dimension, from a coil 11 along a path (represented by arrows 12) of which at least a portion 14 is rectilinear, in which portion the major surfaces of the advancing strip are substantially planar. Preferably the path portion 14 is horizontal. At a locality in this path portion 14, molten polymer is applied to both major surfaces 16, 18 of the strip from two coating devices 20 and 22 (disposed in register with each other respectively above and below the path portion 14 and thus respectively facing the upper and lower major surfaces of the strip article) to establish on each of the strip surfaces a continuous layer or coating 17, 19 of the polymer. Since, for molten polymer coating, the strip must generally be preheated to a temperature close to the melting point of the polymer to be applied, the strip is shown as passing through a preheating zone or station 23 (including heat sources, e.g. of conventional character, not shown, to effect the requisite elevation of strip temperature) just ahead of the coating devices 20, 22. Beyond the coating devices in the path of strip advance, the strip is passed through a heating zone 24 to postheat the coating. After postheating, the coated strip is subjected to cooling as with a conventional water spray quench and/or air jets schematically indicated at a cooling zone or station 25, and is then coiled again, e.g. on a driven rewind reel 26 which constitutes the means for advancing the strip through the coating line. It will be understood that the arrangement of coil 11 and reel 26, with the associated postheating zone 24, is merely exemplary of means for continuously advancing the strip longitudinally along a path having a horizontal rectilinear portion 14 at which the coating devices 20 and 22 are located.

The coating device or coating head 20 includes a rigid coating die 28 comprising a metal block having a surface 30 facing and spaced from the upwardly-facing major surface 16 of the advancing strip article to define therewith a gap 32. The die 28 extends over the entire width of the strip at a locality, in the portion 14 of the path of strip advance, at which the strip is also passing over the lower coating device or coating head 22.

Formed in the die 28 is an elongated slit 34 which opens outwardly through the surface 30 of the die. This slit is axially rectilinear and of uniform cross-section throughout, with its ends closed by dams or shutters (not shown) inserted in and positionally adjustable along the slit to define the ends of the effective (polymer-discharging) aperture of the slit. It is oriented with its long dimension extending horizontally and perpendicular to the direction of advance of the strip 10.

An elongated enclosed manifold chamber 36, typically or preferably of "coat-hanger" configuration, extends within the die 28 along the length of the slit, for containing liquid coating material (molten polymer) under pressure. The slit communicates inwardly with this chamber along the entire length thereof, so that molten polymer (supplied to the manifold chamber through a feed passage 38 constituted of a succession of insulated and flexible tubes and connectors) flows from the manifold chamber through the slit. In operation, molten polymer is continuously delivered from a source (not shown) under pressure (by any suitable, e.g. conventional, means, not shown) to the manifold chamber at a rate sufficient to keep the manifold chamber entirely filled and to force the polymer therefrom under pressure through the slit 34, so that the slit as well is continuously entirely filled with molten polymer under pressure.

As will be understood from the foregoing description, the slit 34, opening through surface 30, extends transversely of the path of strip advance. The location and length of the effective aperture of the slit (established, for example, by the aforementioned dams or shutters) determine the position and width, on the advancing strip, of the coating to be applied. That is to say, the effective aperture of the slit, through which polymer is delivered to the facing strip surface, has a length less than or equal to the strip width, and is disposed for register with that portion of the width of the strip surface 16 which is to be coated. Stated with reference to the direction of advance of the strip past the die 28, the upstream edge of the slit opening is sometimes referred to herein as the entry side, and the downstream edge of the slit opening is sometimes referred to as the exit side of the slit.

The described arrangement of slit and strip results in deposit of polymer from the slit onto the strip surface 16 over the full width of the portion of the surface 16 that coincides with the effective aperture of the slit, i.e. when the slit is filled with molten polymer delivered through manifold chamber 36. The deposited polymer is carried out of the slit as a coating on the advancing strip surface 16, past the exit side of the slit and through the gap between the surface 30 and the strip surface 16 beyond the slit. The downstream edge 42 of surface 30, formed as a sharp discontinuity between the surface 30 and a downstreamfacing, generally vertical surface portion 44, extends across the width of the deposited polymer coating on the strip surface 16 and, together with the surface 16, defines a metering orifice that determines the thickness of polymer coating carried on the strip away from the die; as will be understood, the spacing between the surface 16 and edge 42 should be such as to constitute a gap providing a desired wet thickness of polymer coating on the surface 16, this wet thickness being less than the aperture of the gap. The coated strip surface emerges from beneath the die past edge 42. Preferably, the surface portion 44 meets surface 30 at an angle (at edge 42) of not more than about 90°, for assured avoidance of pick-up of polymer from the strip onto the surface portion 44.

The slit 34 and edge 42 of the die 28 are spaced apart, in the direction of strip advance, so that an extended portion 30*a* of the surface 30 lies between them. Provision of this extended surface portion 30*a* (hereinafter referred to as a land surface), facing the strip surface 16 downstream of slit 34, is important for the coating operation of the invention. The land surface 30*a* is oriented to progressively approach the facing strip surface 16 in the direction of strip advance such that surfaces 30*a* and 16 converge in the latter direction, with the distance between strip and head reaching a minimum at edge 42.

As shown, the upstream and downstream lips of the slit 34, including the downstream lip bearing the land surface 30*a* and edge 42, may be provided as replaceable inserts 45*a*, 45*b* suitably mounted to the die body.

The head 20 further includes structure 46 for supporting the die 28 for vertical movement toward and away from the upwardly facing major surface 16 of a strip advancing in the horizontal path portion 14, i.e., for movement in a direction normal to the path and also normal to the horizontal slit 34 which extends transversely of the path. The tubes of the feed passage 38 are carried by the support structure and communicate with a central locality of the manifold chamber of the die through a connector suitably designed to accommodate limited vertical movement of the die relative to the stationary support structure. It will be understood that while the support structure 46 is typically fixed in position during a coating operation, it may itself be pivotally mounted so that the entire coating head 20 can be adjusted in angle and/or swung clear of the strip path.

In addition, the coating head 20 includes means acting between the support structure 46 and the die 28 (and in particular against a portion of the die which bears land surface 30*a*) for continuously exerting a load on the die (and on the latter portion thereof) to urge the land surface 30*a* toward the facing major surface 16 of the strip 10. This load-exerting means, in the illustrated embodiment of the apparatus, comprises a plurality of air cylinders (one being shown at 48) fixedly secured to the support structure 46 above the die 28. Each air cylinder includes a piston having a shaft 50 which extends downwardly from the cylinder to bear against an upwardly facing surface of the die 28 or a portion thereof.

Thus, actuation of the air cylinders (which may be of a generally conventional character and accordingly need not be described in detail) causes the piston shafts 50 to push the die 28 toward the surface 16 of strip 10 advancing in path portion 14. Advantageously, the localities of engagement of the air cylinder piston shafts with the die are arranged to act on the die at locations spaced along the slit long dimension.

Alternatively, in other embodiments of the invention, the load-exerting means may comprise a single air cylinder, or one or a plurality of hydraulic cylinders, or other devices (such as one or a plurality of helical springs under compression between the supporting structure and the die) capable of yieldably exerting a load on the die to urge the land surface toward the facing, advancing strip major surface.

The lower coating head 22 includes a die 52 which (like the upper head die 28) has a horizontally elongated slit 54 extending transversely of the path of strip advance and opening, through a surface 56 of the die 52, toward a facing major surface of the strip 10, in this case the downwardly facing strip major surface 18. The portion of surface 56 immediately downstream of the outlet edge or exit side of slit 54 constitutes a land surface 56*a* (similar to land surface 30*a* of the upper head die), converging in a downstream direction toward the strip surface 18 and terminating in a sharp transverse downstream edge 58 corresponding to the edge 42 of the upper head die. Molten polymer is supplied under pressure to the slit 54, along the length thereof, so as to be dragged from the slit as a layer on the strip surface 18, the layer being metered at the metering orifice defined between the latter strip surface and the edge 58. The lower head die 52, however, is stationary and fixed in position, rather than being vertically movable during coating operation. The upper and lower slits (34 and 54, respectively) are positioned in register with each other.

In this apparatus arrangement, then, there are provided two coating head dies 28, 52, each defining an elongated open-sided slit (34, 54) and having a land surface (30*a*, 56*a*) immediately adjacent the exit side of the slit, for respectively depositing layers of liquid coating material (molten polymer) on the opposed major surfaces 16 and 18 of a strip article 10 advancing in the path 12; and means for supplying the molten polymer under pressure to the slit of each die.

The movable support of the upper head die 28 permits variation in the vertical spacing between the land surfaces 30*a* and 56*a* notwithstanding that the lower head die 52 is stationary. The heads 20 and 22 are so positioned that their slits respectively open toward the opposed major surfaces of an advancing strip article in the rectilinear path portion 14 with the long dimensions of the slits extending transversely of the path, and with the respective land surfaces of the two dies disposed, substantially in register with each other, beyond the slits in the direction of strip article advance. These extended surfaces respectively face the opposed major strip surfaces 16 and 18 and converge toward each other and toward the strip surfaces in the direction of article advance. During operation, with the strip article advancing past the slits and molten polymer supplied to both slits, the article major surfaces respectively drag layers of coating material from the slits, the layers being thereby deposited on the article major surfaces.

The air cylinders constitute means for continuously exerting a load on the upper head die and, in particular, the portion thereof bearing the land surface 30*a,* to urge the latter surface downwardly, toward the upwardly-facing major surface of a strip article advancing in the path portion 14, and of course also toward the land surface 56*a* of the lower head die, this load acting on the strip through the coating layer on surface 16 such that, during operation as aforesaid, both land surfaces are effectively urged by the load-exerting means against the respective layers of coating material deposited on the strip major surfaces to maintain the deposited coating layers at predetermined constant thicknesses while the coating layers alone hold the heads entirely away from contact with the strip article major surfaces.

At all times, contact between the moving strip and the die surfaces/edges is prevented. In an illustrative startup procedure, the two dies are positioned close to, but not in contact with, the slowly moving strip; flow of polymer to the dies is started so that a bead of polymer develops at the exit slot of each die; the dies are brought together with a minimum applied pressure, the strip is accelerated to a predetermined coating speed, and the desired pressure is applied to the cylinders. Thereby, a metering orifice is defined between each head edge 42 or 58 and the facing strip surface 16 or 18, the size (aperture) of this orifice being determined (for molten polymers of a given viscosity) by the magnitude of the load exerted on the die 28 by the cylinders 48.

The rates of polymer flow through the slits, and the fluid pressure of polymer acting on the strip surfaces in the gaps beyond the slits, are primarily determined by drag forces of the strip rather than by the supply pressure of polymer in the coating heads. Thus, a small positive polymer supply pressure is typically sufficient, and the aforementioned drag forces, as the strip surface moves past the slot opening, create much higher fluid pressures between the strip surfaces and the facing land surfaces.

As advance of the strip 10 continues, with continuing supply of polymer under pressure to the slits, uniform layers of polymer are deposited on the opposed strip surfaces. Throughout the operation, the cylinders continuously maintain a load on the die 28, effectively urging both dies toward the strip surfaces being coated, and these loads serve to maintain the apertures of the aforementioned metering orifices constant, regardless of local variations in strip thickness. In effect,.each land surface 30*a* or 56*a* floats on the layer of polymer being applied through its associated slit 34 or 54, and is maintained (by that layer alone) entirely away from contact with the facing strip surface while coating proceeds. The invariant aperture of each metering orifice, resulting from the described load, produces polymer coatings of uniform thickness.

Stated more generally, the purpose of the load-exerting means is to exert, on the applied liquid coating layer between each coating head and the facing strip surface, a load which is maintained essentially constant across the full width of the strip and throughout the duration of a given coating operation, thereby to achieve the desired constant and uniform aperture of the metering orifice.

Satisfactory operation of the described coating line requires that the clearances between the land surfaces 30*a* and 56*a* of both dies and the strip converge in the direction of sheet travel, to generate a hydrodynamic pressure, between the extended surface of each head and the strip, that will increase as the strip gets closer to the land surface. Provided that the angles of convergence ate chosen correctly, there will be an equilibrium position for the strip where the pressure forces on both sides will be equal.

The coating line tends to be self-centering in operation, in that the greater the force that is applied by the air cylinders 48 to the upper head die 28, the more counteracting force pushes up on the lower surface of the strip. The position of equilibrium and hence the coating film thickness distribution on the two major surfaces of the strip can be controlled in two ways, viz. by varying either the angle of convergence or the lengths (in the direction of strip advance) of the extended surfaces of the heads. Within limits, increasing the angle of convergence will increase the hydrodynamic pressures generated. Therefore, increasing the angle for one of the two heads will cause the position of strip equilibrium to shift away from that head and the coating film thickness on that side of the strip will increase (suitable means for adjusting this angle may be provided as shown in U.S. Pat. No. 4,675,230 and the aforementioned PCT publication. Similarly, increasing the length of the extended surface of one of the heads will cause the film thickness to increase on that side of the strip.

As thus far described, the coating line of FIGS. 1A, 1B and 2 is generally similar to those of the aforementioned U.S. Pat. No. 4,675,230 and especially certain two-sided coating lines of the aforementioned PCT publication. Like those coating lines, the coating line of the present invention in the described embodiment incorporates a die for applying and controlling the distribution and thickness of a coating medium onto a moving sheet metal surface or other suitable substrate.

As a particular feature of the present invention, however, the design (now to be described) of the upper head die 28 is such that a die lip or land portion 60 on the exit side of the die 28 can be flexed in a direction which is normal to the major surfaces of the strip advancing in the path portion 14 to be coated, but resists flexing in the direction parallel to the strip major surfaces. Furthermore, by choosing the particular die materials and cross-section dimensions in the portion 60, the flexibility can be engineered to meet the process requirements.

In the embodiment of FIGS. 1A and 1B, the land portion 60 bears the land surface 30*a* as well as the downstream edge 42 and vertical surface 44, and defines the downstream side of the slit 34 along the full length of the slit. The main body 28*a* of the die 28 (including the portion defining the upstream side of the slit, and the manifold chamber) is of such cross-sectional dimensions as to be substantially rigid with insignificant deflections arising from the internal pressure of the coating material and the various forces which act upon it. The land portion 30*a,* in this embodiment, is formed integrally with the main die body 28*a* and is cantilevered relative thereto, with a free lower or outer end bearing the land surface 30*a* on the exit side of slit 34, being dimensioned and designed so that it can flex to accommodate variations in gauge and flatness of the strip 10 being coated (as shown, the cross-sectional dimension of the portion 60 in the plane of FIG. 1A is relatively narrow for most of its length). The flexing of the die lip or land portion 60 occurs in response to the combination of hydrodynamic pressure generated under the die lip and due to the liquid coating which is being applied, and the forces applied by the pneumatic or hydraulic cylinders 48. The cross-sectional dimensions of this cantilevered upper die land portion are such that it is flexible enough to accommodate variations on the order of 150 microns over the width of the die. It should be noted that the stiffness of the section will not allow the land portion 60 of the die to conform to short wavelength strip variations of less than a few centimeters across the width but will allow it to respond to longer range variations. This gives a "smoothing" effect as the coating is applied.

Forces act on the die land/lip portion 60 in the direction of strip advance in the path 12 owing to viscous drag by the coating, and to the polymer pressure in the slit. These forces tend to deflect the die land portion 60 in a direction parallel to the direction of strip advance. Since this can be undesirable, the shape and dimensions of the die and its cantilevered land portion are selected so that the land portion will be relatively resistant to bending or flexing in the strip-advancing direction.

Since the main die body 28*a* and the flexible land portion 60 respectively define opposite (upstream and downstream) sides of the slit 34 and its associated feed channel for flow of polymer, deflection (flexing) of the land portion relative to the main die body will cause a change in the dimension of the channel through which the polymer flows. In turn, this will affect the flow rate of the coating. However, for the intended applications (coating sheet materials), the amount of such variation in channel dimension (a few microns), in a total channel width of 1 mm or more, will not have a noticeable effect.

As already mentioned, for application of 100% solids coating materials (molten polymers), the dies of the coating line must incorporate heating elements and must have specially designed, polished channels to ensure uniform distribution of the coating. These elements and channels can be accommodated in the main die body 28*a* of the embodiment of FIGS. 1A and 1B. At the same time, by the provision of a lip or land portion 60 which is flexible enough to conform to the sheet, the invention overcomes the problem of achieving requisite flexibility in a die that must have such heating elements and special channels. That is to say, in the coating head die of the invention, the part of the die which needs to be flexible is flexible, and the main body of the die is substantially robust and stiff.

It may be noted that the flexible land portion of the die of the present invention differs in significant respects from the variable geometry polymer film extrusion dies which are commonly used in the plastics industry, e.g. as described in U.S. Pat. No. 5,067,432, issued Nov. 26, 1991. The latter dies have an adjustable lip designed to allow the slot dimension of the die to be changed so that the polymer flow and film thickness across the width of the die can be adjusted (usually to get uniform thickness in extruded film); in the dies of the present invention, the purpose of the flexible section is to allow the die lip to maintain a hydrodynamically controlled contact with the coating on the substrate. Any incidental changes in the slot width will be very small relative to the total slot width (typically on the order of about 1%).

Moreover, in the aforementioned plastic film extrusion dies, the lip adjustment is typically made using a series of set screws and after this adjustment, the die lip is not free to flex; i.e., the die lip is preset and is not intended to change dynamically during the extrusion of film. In contrast, the dies of the present invention are not preadjusted to fixed positions, but are able to flex in response to the hydrodynamic forces from the coating and to the variable applied pressures from the loading cylinders.

Furthermore, the present design enables the die lip to be displaced in a direction which is normal to the coated surface, while substantially resisting displacement in a direction parallel to the coating surface (along the direction of coating).

To summarize, in the embodiment of FIGS. 1A and 1B, the coating head die of the invention includes, in an integral die block, a main die body that is substantially rigid and a cantilevered downstream lip or land portion that can undergo transverse flexing in a direction normal to the surface of the strip being coated, but not in a direction parallel to the strip surface. By isolating the movement of the land surface 30*a* in this way, the invention achieves the flexing properties desired for the metering portion of the die even though the main die body must be dimensioned to accommodate heating elements for molten polymer, since the heaters can be located in the part of the die not directly involved with metering the coating fluid onto the strip surface.

In itself, the flexible lip or land portion of the die can achieve only a very small amount of vertical flexing movement. To provide a coarse adjustment feature with an advantageously larger range of vertical movement, the coating head 20 of FIG. 1A includes an arrangement of the die 28 and support structure 46 enabling the entire die body to move a significant distance (for example 1 cm. or more) in a direction perpendicular to the surface of the strip being coated. Thus, the relatively massive main die body 28*a,* which extends above and downstream (with respect to the direction of strip travel) as well as upstream of the cantilevered land portion 60, is received within a recess 62 formed within the fixed support structure 46, this recess being dimensioned to permit substantial though limited movement of the entire die 28 relative to the support structure. It will be understood that the die and recess 62 both extend from end to end of the coating head, transversely of the strip being coated, and are substantially uniform in dimension and configuration throughout their length.

Within the recess 62, on both the upstream and downstream sides of the main die body 28*a,* are provided needle bearing cartridges 64 and 66 disposed between the sides of the recess and the die body; the upstream one of these cartridges is itself horizontally slidable relative to the support structure, and is spaced from the adjacent side wall of the recess 62 by Belleville washers 68 that accommodate differential expansion of the die and support structure. The needle bearings allow the die body to slide vertically within the support structure in response to the applied forces from the piston rods 50.

The molten polymer inlet passage 38 is represented, in FIG. 1A, as including an insulated tube 38*a* extending through a clearance hole in a trunnion of the support structure; a flexible tube connector 38*b* leading from tube 38*a;* and a connector 38*c* leading from tube connector 38*b* to the interior of the die 28. This arrangement is exemplary of suitable passage systems for delivering molten polymer to a die that is vertically moveable, as on the illustrated needle bearings, relative to the support structure of the coating head.

As further shown in FIG. 1A, the air cylinders 48 are mounted above a portion 46*a* of the support structure which is above the downstream part of the die body 28*a,* and the cylinder pistons 50 extend downwardly through Graphalloy bushings 70 inserted in openended passages 72 formed in support structure portion 46*a.* For each cylinder and its associated piston, there is provided a chock 74 at the lower end of passage 72; the chock is removably secured to the piston by means of a pin 76 so as to move vertically therewith. The lower end of the chock has a lateral projection in the form of a dovetail projection 78 which is inserted in an upwardly-opening dovetail socket or recess 80 formed in the downstream part of the main die body 28*a* directly above the land portion 60, the projection 78 and recess 80 being mutually dimensioned to permit limited vertical movement of the chock relative to the die body. The dovetail feature allows dies to be interchanged quickly and easily.

Below the dovetail projection of each chock, a push rod 82 extends downwardly, through a passage (not shown) in the downstream part of the main die body 28*a,* to a flat horizontal upper surface 60*a* of the outer (unsupported) end of the cantilevered land portion 60 of the die, such that the chock can bear downwardly against the upper end of the push rod. Through the chock and this push rod, the load exerted by each air cylinder 48 is transmitted directly to the land portion.

While the extent of permitted vertical movement (i.e., in a direction normal to path 12 and strip 34) of the die 28 as a whole relative to the support structure 46 is determined by the relative vertical dimensions of recess 62 and the portion of die body 28*a* received wherein, the extent of permitted vertical movement of the land surface 30*a* relative to the main die body 28*a* is determined by the vertical clearance between the dovetail projection 78 and dovetail recess 80. Typically, and preferably, there is a relatively large amount of vertical clearance between the complete movable die and the rigid supporting structure, compared to a relatively small amount of clearance between the dovetail projection and dovetail recess.

In the head of FIG. 1A, the dovetail feature is present to enable the die 28 to be raised (within the vertical clearance provided by recess 62) during interruptions in the coating process so that the head can be swung out of the way (the head pivots on the support structure in the direction of strip movement in order to facilitate servicing). The coarse adjustment feature provided by bearings 64 and 66 is present primarily for the purpose of aligning the die 28 with the strip 10 at the start of the coating process so that the die can position itself to follow the strip profile (i.e. gross surface contour across the width of the strip, within which accumulated variation due to machining tolerances, thermal distortion of the die and sheet gage variation may total up to 150$\mu$) and also to compensate for different strip thicknesses. During coating operation, the head is not expected to move more than about 2$\mu$, which vertical movement is entirely accommodated by the clearance between dovetail portion 78 and recess 80; this is so, in the described head, because the force of the air cylinders is applied directly to the land via chock 74 bearing on push rod 82 which in turn bears on the land. Of course, if unusually large variations in strip profile are encountered during a coating run, the coarse adjustment feature will automatically be brought into play to result in greater vertical movement of the die.

With this system, the die as a whole will easily adjust in vertical position to accommodate different sheet gauges, while the flexible lip or land portion 60 can respond quickly to small fluctuations in gauge both along and across the strip. That is to say, since the die as a whole is mounted in the needle bearings and acted on by the air cylinders, the land surface 30*a* automatically aligns itself with the facing (upper) major surface 16 of a strip article 10 being coated (coarse adjustment); once the head as a whole is so aligned, the flexing of the land portion 60 takes over to adjust for the small strip surface irregularities that could affect the consistency of coatings which are on the order of only a few microns thick (fine adjustment). In this way, the tolerances of the coating head die and support components are less exact than would be required if only the land portion was movable.

Performance of a strip-coating operation with the coating line of FIGS. 1A, 1B and 2 may be generally as described in the aforementioned PCT publication except that the loading force is exerted on the land surface of the movable coating die, and transmitted to the main die body through the flexible land portion, which is capable of movement isolated from the die as a whole, to enable desired flexing of the land surface-bearing portion in a die which must be made relatively bulky and rigid to accommodate heating elements for molten polymer coatings.

FIGS. 3A, 3E, 4A, 4B, 4C and 5 illustrate a currently preferred coating head die 128, in accordance with the present invention, that may be used in the coating head 20 of FIG. 1A, i.e., in place of the head 28 with its free-ended cantilevered lip or land portion 60. The die 128 has a downwardly-facing surface 130 through which opens a slit 134 for discharging liquid coating material (e.g. molten polymer) onto the upwardly-facing major surface of a strip article advancing longitudinally in the path indicated by arrow 12. The interior of the die body defines a manifold chamber 138, typically of "coat-hanger" shape, extending along the length of the slit for delivering molten polymer thereto. As in the case of the die 28, the die 128 is mounted for use with its surface 130 and slit 134 facing downwardly and extending horizontally, transversely of the strip surface to be coated.

Spaced downstream from the exit side of the slit is a downstream edge 142 of the surface 130, corresponding in position, configuration and function to the edge 42 in die 28 of FIGS. 1A and 1B. The extended portion 130*a* of surface 130 between the exit side of the slit and edge 142 constitutes a land surface, corresponding to the land surface 30*a* of die 28, and converging toward the surface of the strip to be coated in the direction of strip advance. This land surface 130*a* is formed on a relatively flexible lip or land portion 160 of the die 128. The land portion 160 is formed integrally with the main body 128*a* of the die and defines the downstream side of the slit 134, being connected on its upstream side (with reference to the direction of strip advance) to the main die body by an extended portion 160*a* of relatively narrow cross-section, and also being connected on its downstream side to the main die body by a relatively thin web 160*b* of the die body material. Thus, the land portion 160, unlike the land portion 60 of FIG. 1A, is supported on both its upstream and downstream sides. Nevertheless, the shapes and cross-sectional dimensions of both the upstream and downstream connecting portions (160*a* and 160*b*) are such that the land portion 160 is capable of flexing, relative to the main die body 128*a,* in a direction normal to the strip surfaces to be coated, but not in a direction parallel to the strip surfaces; i.e., the same isolation and independent flexibility of the land portion is thereby provided, for the same purpose, as in the die 28 of FIG. 1A.

The main die body 128*a* in FIGS. 3A–5 is provided, in its upper downstream portion, with an upwardly opening dovetail socket or recess 180 identical to the dovetail recess 80 of the die body in FIG. 1A. The die 128 may accordingly be mounted in the recess 62 of the supporting structure 46 of FIG. 1A, in place of the die 28, and as thus mounted will function in the same manner as the die 28, with coarse and fine adjustment achieved as described above. As illustrated in FIGS. 4B and 4C, when the die 128 of FIGS. 3A–5 is assembled with the supporting structure and air cylinders of FIG. 1A, the push rod 82 associated with each piston 50 extends downwardly through an opening 182*a* in the main die body 128*a* below the dovetail recess to bear against an upwardly-facing surface of the land portion 160, as represented by arrow 182 in FIG. 4A.

More particularly, the pin 76 extends through a forked projection 74*a* permanently attached to the lower end of the piston rod 50 and through the upper portion 74*b* of the chock bearing dovetail projection 78, to secure the chock to the piston. In coating position (FIG. 4B), with the piston extended downwardly, the dovetail portion bears against the upper end of push rod 82 to exert force on the die land portion 160. In retracted position (FIG. 4C), to enable the coating head to be pivoted away from the strip for servicing, the piston is raised, and the dovetail portion 78 engages the converging upper walls of recess 180 to lift the die 128 upwardly; the dovetail portion is then spaced above the push rod. It will be appreciated that the illustrated combination of piston, chock and push rod is typically one of a plurality of pistons, with associated chocks and push rods, provided at spaced locations along the length of the die 128 and transversely of the direction of strip advance.

Figure 4A:
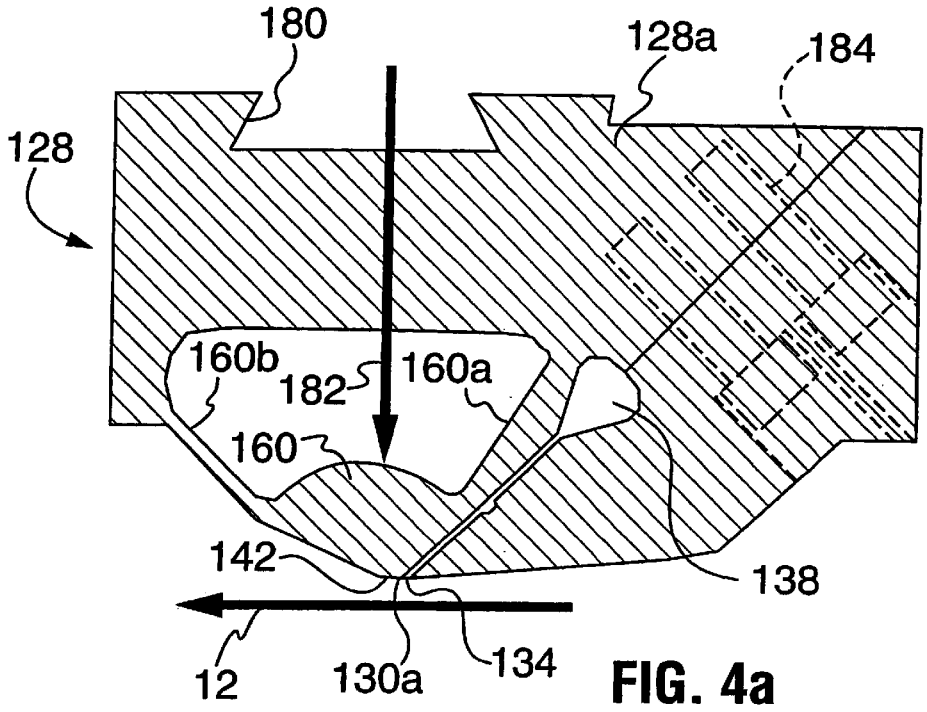
FIG. 4A is a simplified, larger-scale, side elevational sectional view of the preferred coating head die of FIG. 3A, as seen from the side opposite that of FIG. 3A.
Figure 4B:
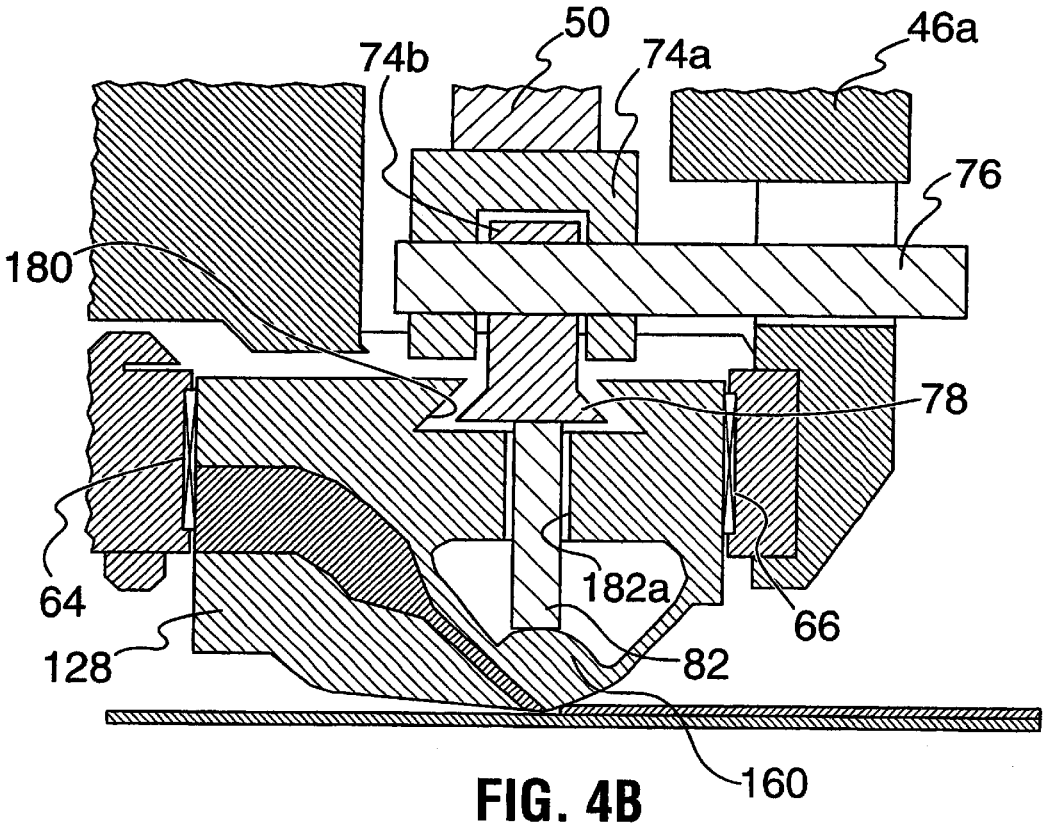
FIGS. 4B and 4C are views similar to FIG. 1A of a coating head incorporating the die of FIG. 3A, in operative (coating) and inoperative (raised) positions, respectively.
Figure 4C:
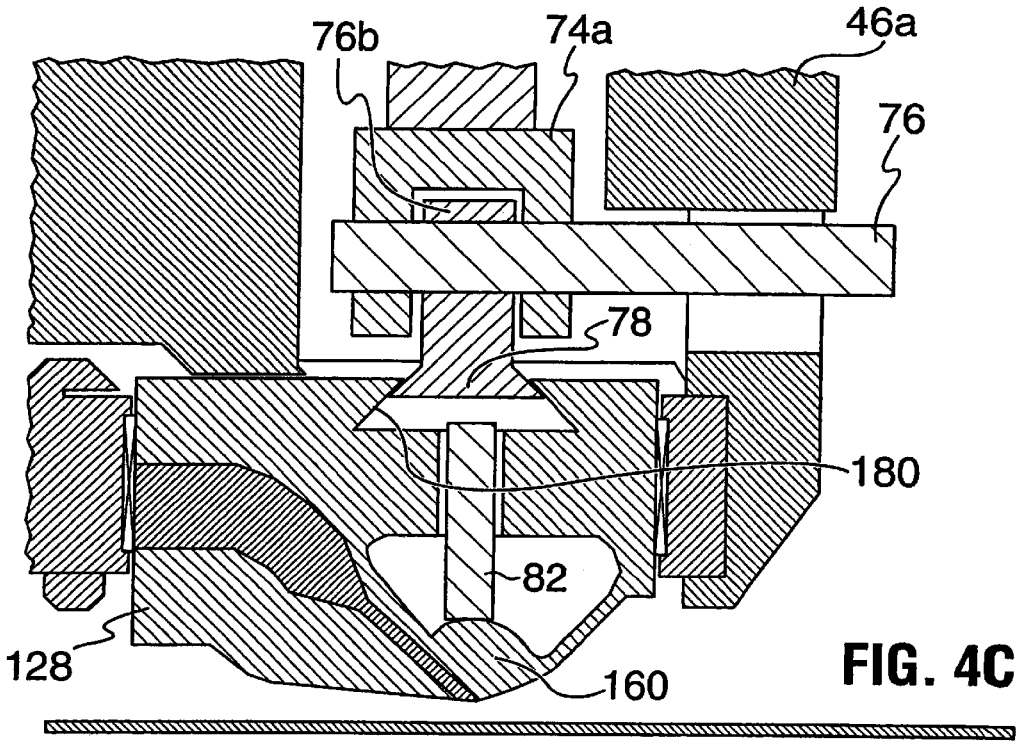
Figure 4D:
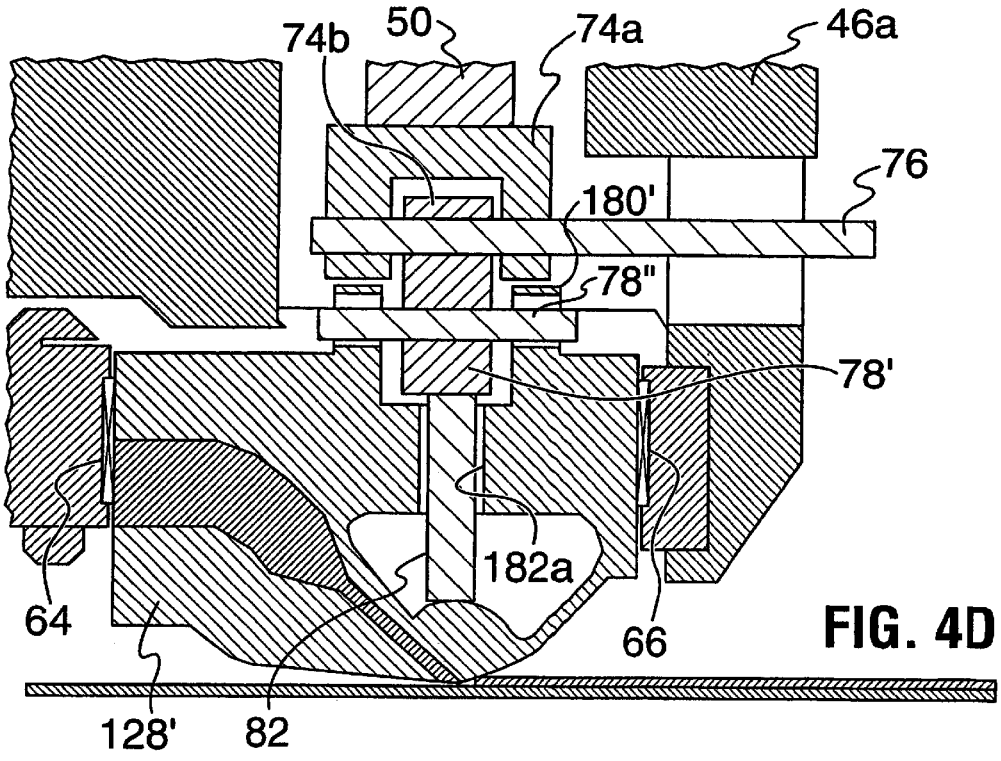
FIGS. 4D and 4E are views similar to FIGS. 4B and 4C, respectively, of a modified form of the coating head and die.
Figure 4E:
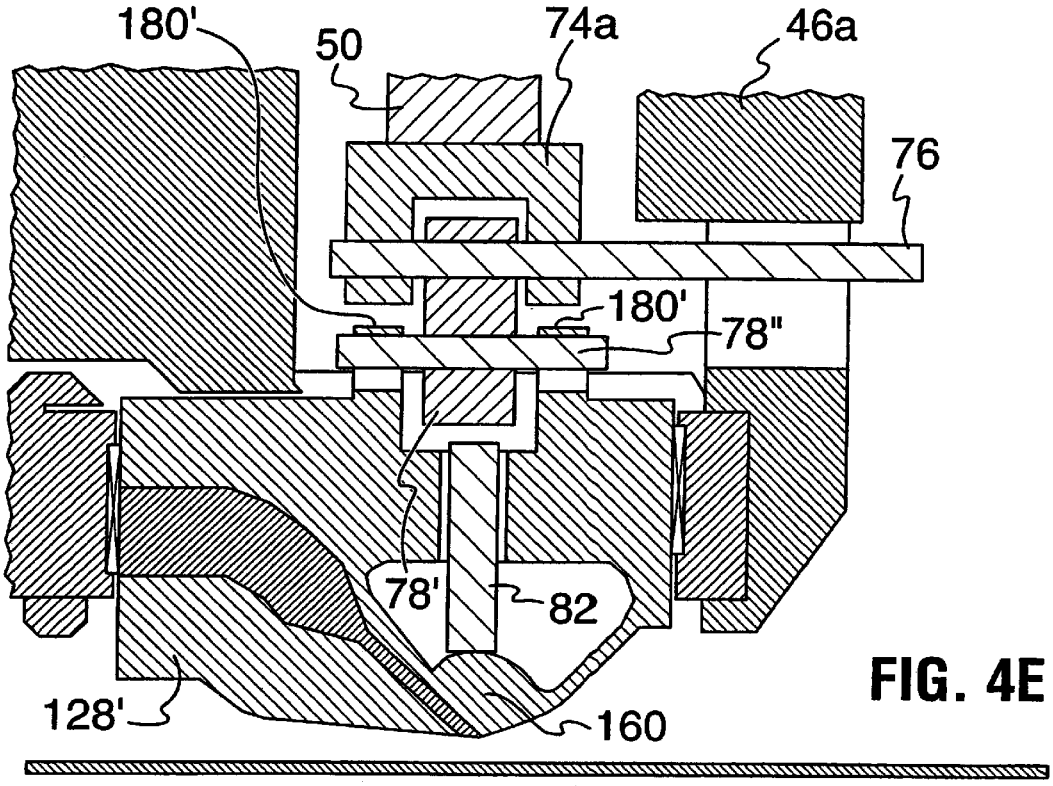

In the modification shown in FIGS. 4D and 4E (which again respectively show the coating position and retracted position of the die), the chock including dovetail portion 78 is replaced by a chock having a straight portion 78' extending down from the upper portion **74*b* and carrying a lateral projection in the form of a horizontal pin 78" that extends through sockets or apertures of ears 180' formed on the top of the die 128'. The ear apertures are so positioned and dimensioned that, when the piston is extended downwardly, the chock bears against the push rod 82 to exert force on the die land portion 160, and there is clearance between pin 78" and the ears 180' (similar to that between dovetail portion 78 and recess 180 in FIG. 4B) to permit vertical movement of the land portion relative to the main die body. When the piston is raised, elevating the chock away from the push rod, the pin 78" engages the ears 180' to lift the die 128'**.

Figure 3B:
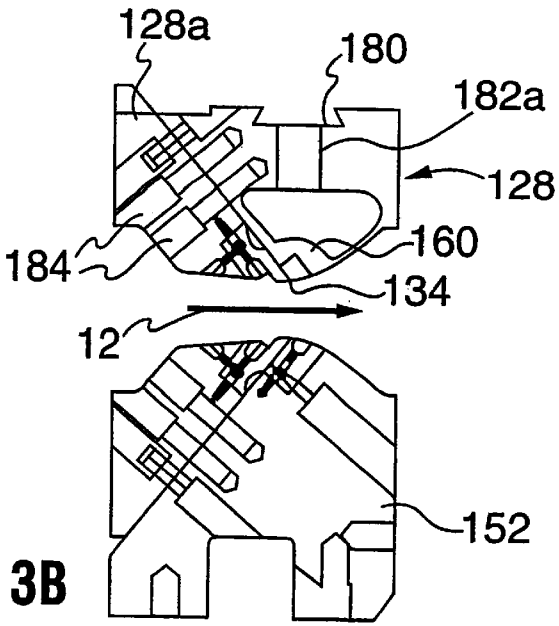
FIG. 3B is a view, similar to FIG. 3A, of the same coating head dies in a second vertical plane parallel to the strip path.
Figure 3A:
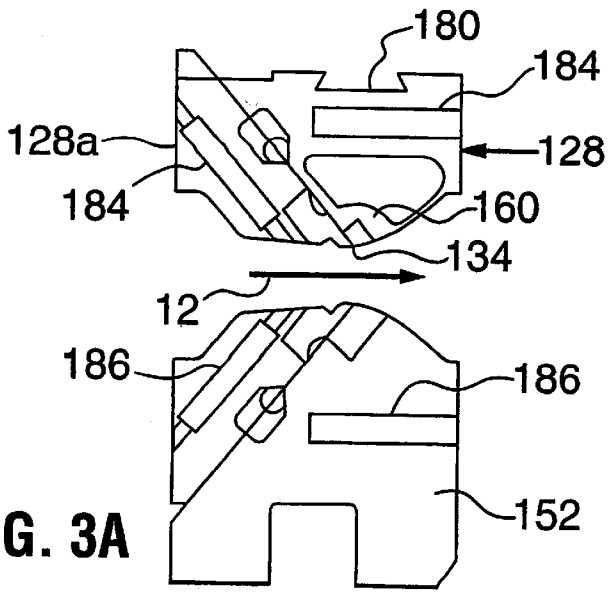
FIG. 3A is a side elevational sectional view, at a scale intermediate FIG. 1 and FIG. 2, of a currently preferred embodiment of the die of the coating head of the invention and an associated fixed die (for two-sided coating of aluminum strip) in a first vertical plane parallel to the path of strip advance.

FIGS. 3A and 3B, representing sections at different points along the length of the die 128, illustrate also the arrangement of heating elements 184 within the main body of the die to keep the polymer molten during the coating operation. In addition, FIGS. 3A and 3B show sections through a preferred form of stationary lower die 152 (corresponding in structure and function to the die 52 of FIG. 1A), again including heating elements 186 for keeping the polymer molten. It will be seen that in the die 128 the heating elements can be positioned as close to the manifold chamber and slit as needed without encroaching upon, or affecting the bulk and flexibility of, the flexible land portion 160.

Figure 5:
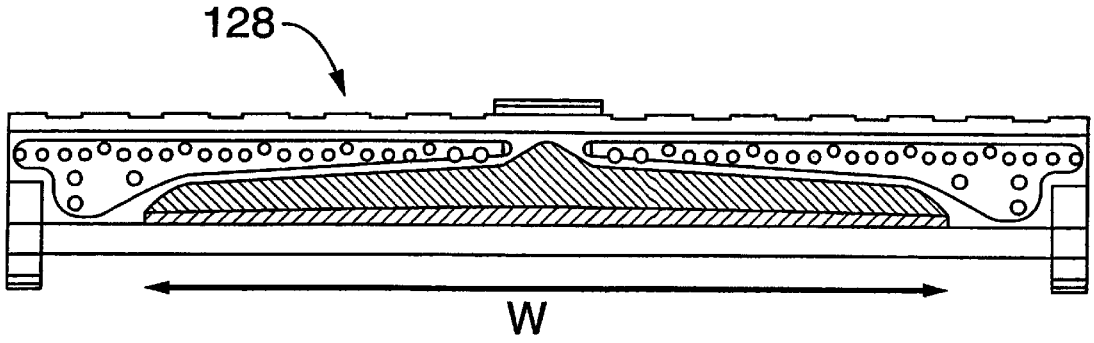
FIG. 5 is a simplified sectional plan view of the coating head die of FIG. 3A, at a reduced scale.

FIG. 5, a section through the plane of the slit and coat-hanger cavity of die 128, shows the positional relation of the long dimension of the die and the width W of the strip being coated.

Figure 6A:
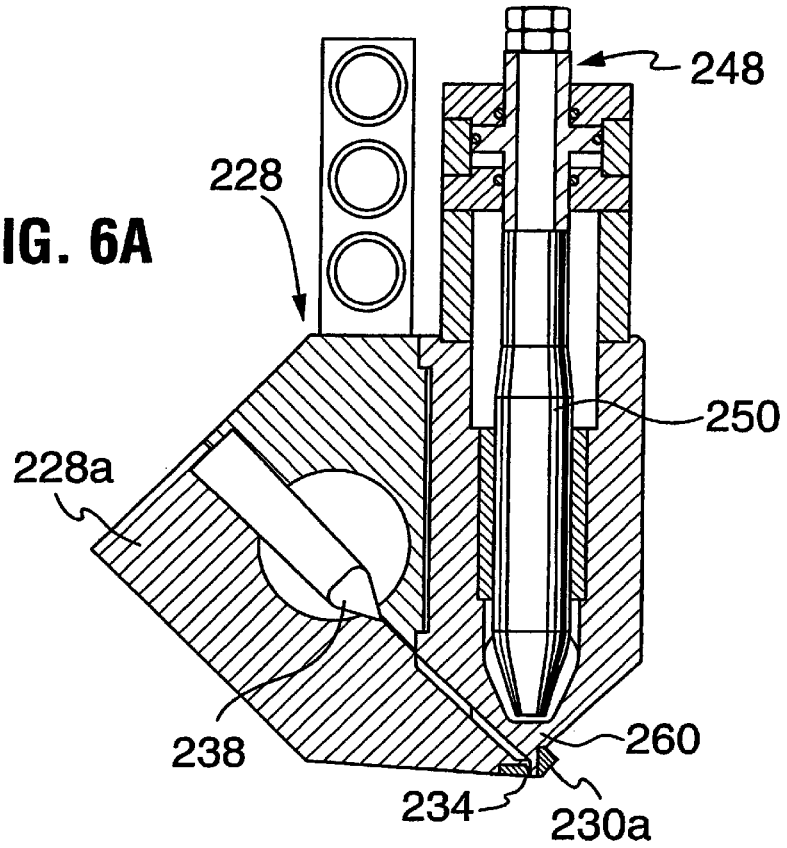
FIG. 6A is a side elevational sectional view of another embodiment of the coating head of the invention.
Figure 6B:
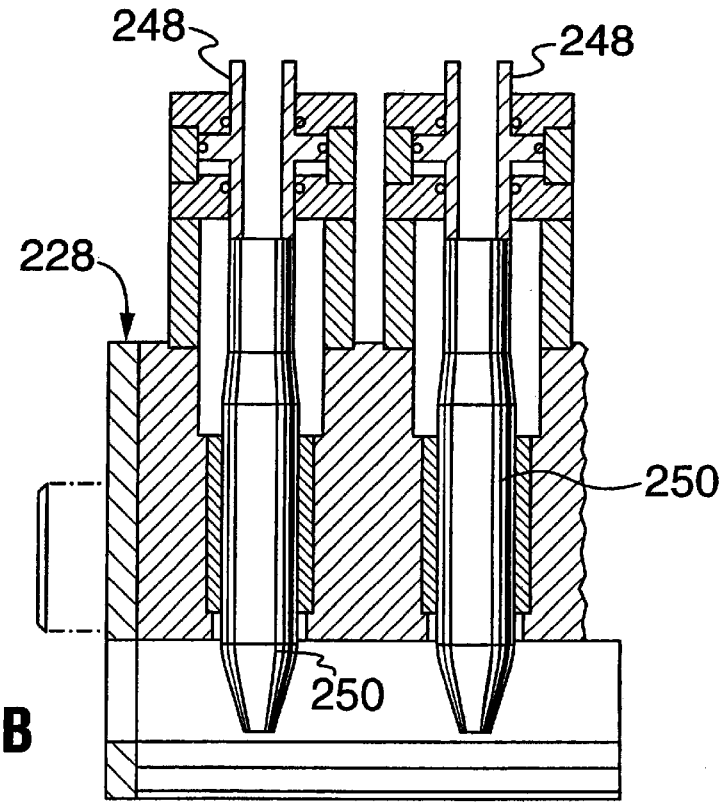
FIG. 6B is a fragmentary front elevational sectional view of the coating head of FIG. 6A.

A modified embodiment of the die of the coating head of the present invention is shown in FIGS. 6A and 6B, in side and fragmentary front elevational sectional views. In this embodiment, the upper head die 228 includes a main die body **228*a* defining the upstream side of a slit 234 with a manifold chamber 238, and a land portion 260 defining the downstream side of slit 234 and bearing the land surface 230*a* which corresponds positionally, structurally and functionally to the land surfaces 30*a* of FIGS. 1A and B and 130*a* of FIGS. 3A–5. The land portion 260, like that of FIGS. 3A–5, is supported on both its upstream and downstream sides and is acted on by the pistons 250 of air cylinders 248** spaced along the length of the die (FIG. 6B).

Figure 7:
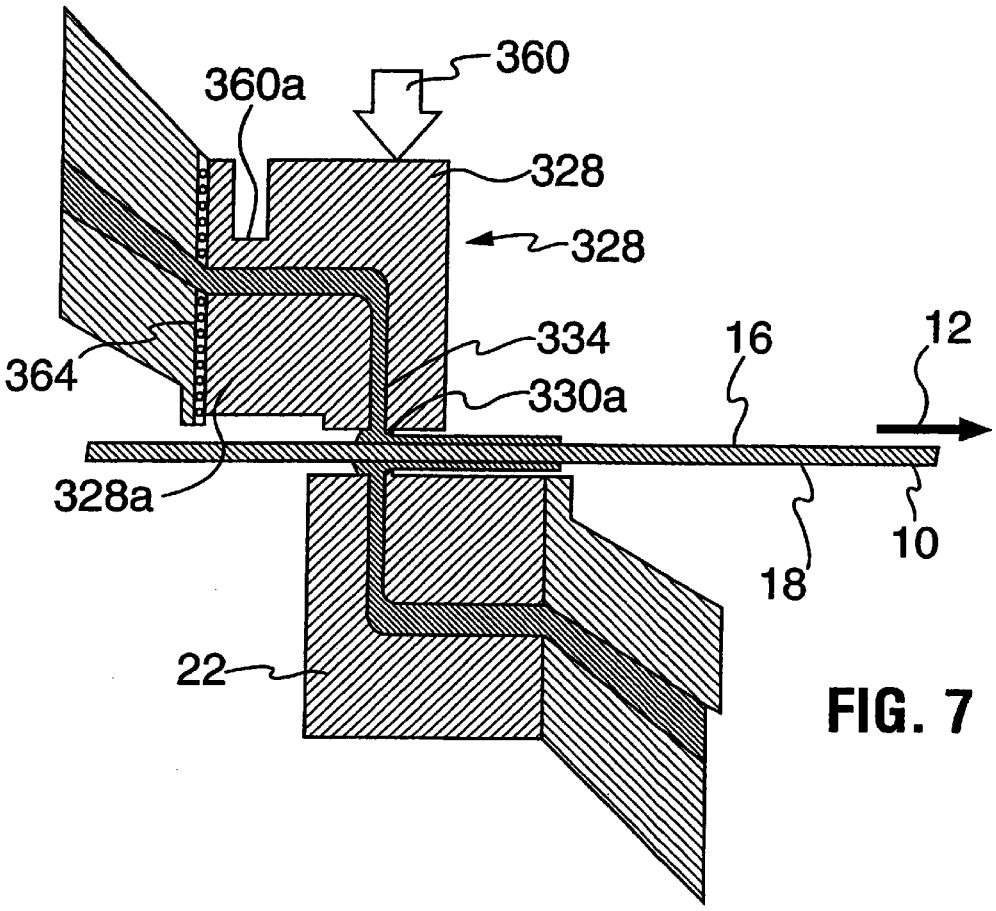
FIG. 7 is a highly simplified and schematic side elevational sectional view, similar to FIG. 1, of a further embodiment of the invention.
Figure 8:
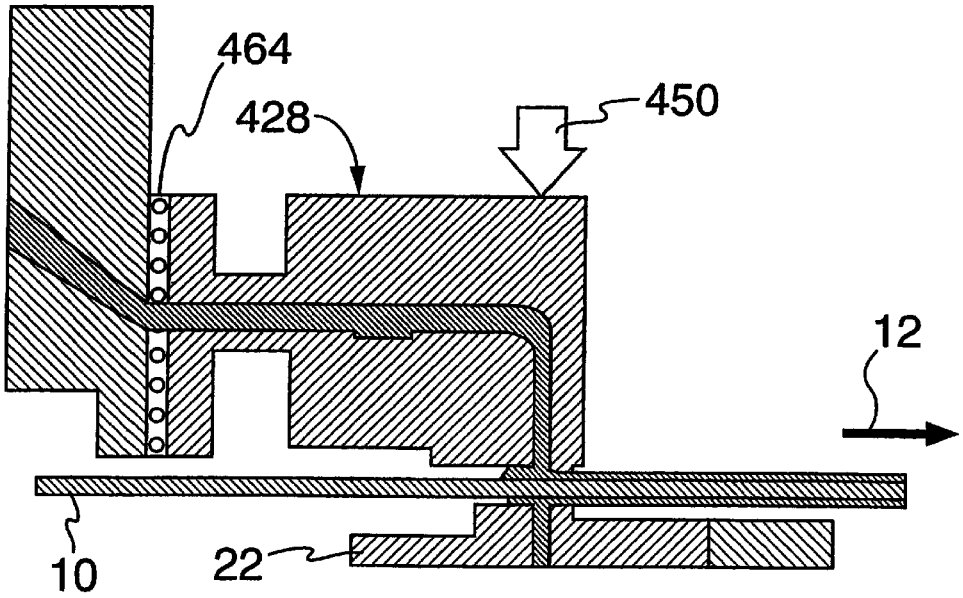
FIG. 8 is a view similar to FIG. 7 of yet another embodiment of the invention.

FIGS. 7 and 8 show two further embodiments of the coating line and die of the invention. Each of these embodiments is shown as associated with the stationary lower coating head 22 of FIG. 1A. In FIG. 7, the upper head die 328 includes a lower portion **328*a* defining the upstream side of the die slit 334, and an upper portion 360 defining the downstream side of the slit and carrying the land surface 330*a* which corresponds to land surface 30*a* of FIG. 1A. While die portion 328*a* is substantially rigid with insignificant deflections arising from the internal pressure of the coating material and the various forces which act upon it, die portion 360 is designed (with reduced-thickness region 360*a*) so that it can flex vertically (in a direction normal to the surface of a strip article 10 being coated) to accommodate variations of a few microns in the gauge and flatness of the sheet being coated, but does not flex in a direction parallel to the strip surface. Air cylinders or other load-exerting means as discussed above act directly on the die portion 360, as indicated by arrow 350. The entire die body constituted of portions 328*a* and 360 is supported on one side by a bearing, such as a needle bearing diagrammatically indicated at 364, so as to be vertically movable (i.e., in a direction normal to the surface of the strip article 10 being coated), with an extent of vertical movement greater than the extent to which the die portion 360 can flex vertically relative to the die portion 328*a***.

Similarly, the die 428 of FIG. 8 is provided with a portion capable of a minor degree of flexing in a direction normal to (but not parallel to) the surface of strip article 10 being coated, such portion being acted on by air cylinders (arrow 450); the die is also supported by a needle bearing structure 464 or the like so as to be movable as a whole in the aforesaid normal direction.

Figure 9:
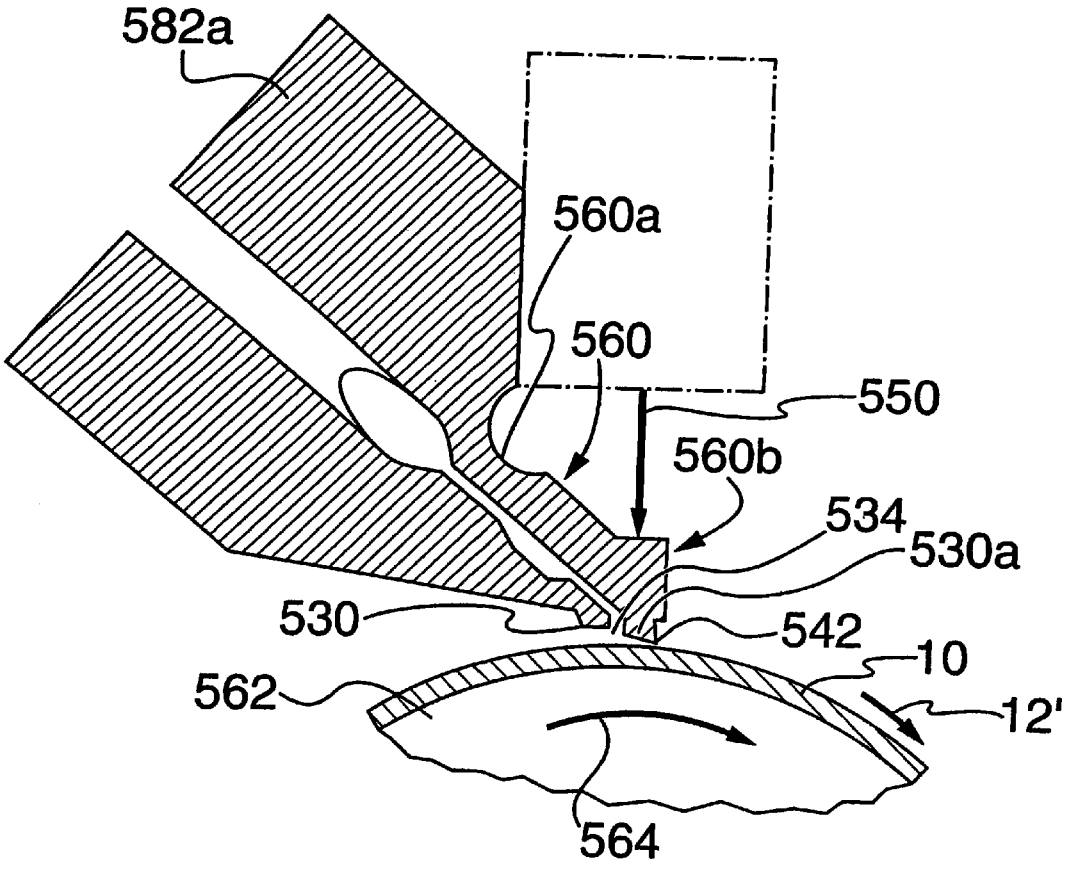
FIG. 9 is a simplified side elevational sectional view of yet another embodiment of the coating line of the invention.

Yet another embodiment of the coating head of the invention is illustrated in FIG. 9. In this embodiment, the die 528 has a main die body **528*a*, a lower surface 530, a slit 534, and a land surface 530*a* on the exit side of the slit with a sharp downstream edge 542. The land surface is carried on a land portion 560 formed integrally with the main die body and constituting the exit side lip of the slit. Portion 560 has a thinned, flexible section 560*a*, allowing the lip to cantilever, while the region 560*b* nearer the lip is stiffer providing the smoothing effect and minimizing flexing parallel to the coating direction. Air cylinders exert a load directly on the lip at region 560*b*, as indicated by arrow 550. The die 528 is carried on fixed support structure by means of a bearing (not shown) permitting vertical movement of the entire die body, as in the case of the embodiments of FIGS. 7 and 8**.

Although the die 528 can be employed for either one-sided or two-sided coating of strip, it is shown in FIG. 9 in a one-sided coating line. In place of a lower coating head, the one-sided coating line includes means, such as a roll 562 around which the strip 10 is trained, for supporting the strip on the lower side thereof. The roll 562 (which rotates in the direction indicated by arrow 564, with the strip advancing in the direction of arrow 12') has an axis parallel to the long dimension of the slit 534 and fixed in relation to the means supporting the coating head above the strip. The cylindrical surface of the roll is positioned closely adjacent (and beneath) the slit open side; land surface **530*a* is shaped and positioned to approach progressively nearer the roll surface in the direction 12'** of advance of the strip.

What is claimed is:

1. A method of continuously applying a layer of liquid coating material to a major surface of an elongated flexible strip article (10), including continuously longitudinally advancing an elongated flexible strip article (10) having a major surface to be coated along a path, supplying liquid coating material to an elongated, open-sided slit (34) with an entry side and an exit side defined in a die (28) of a coating head, said die including a land portion (60) at the exit side of the slit (34); characterized by:

(a) providing an extended land surface (**30*a*) at the exit side of slit (34**);

(b) supporting the die (28) in facing relation to a major surface of a strip article (10) advancing in the path while permitting individual translational movement of the die (28) in a direction normal to the last-mentioned strip (10) major surface, said die (28) being positioned such that the slit (34) opens toward and extends transversely of the last-mentioned strip (10) major surface, such that said land surface (30*a*) is disposed facing the last-mentioned major surface of the advancing strip article (10) and converging toward the path in the direction of strip article advance, and such that the last-mentioned article (10) major surface drags a layer of coating material from the slit (34), the layer being thereby deposited on the last-mentioned article (10) major surface;

(c) continuously exerting a load on at least said land portion (60) of said die (28) such that the layer of coating material deposited on said last-mentioned article (10) major surface is pressed between said land surface (30*a*) and said last-mentioned article (10) major surface to maintain said layer at a predetermined constant thickness while said layer alone holds the head (20) entirely away from contact with the article (10) major surface;

(d) said die (28) including a main body defining at least the entry side of the slit (34), and said land portion (60) being so connected to said main body as to flex relative thereto in said normal direction as variations in an advancing strip article (10) pass the land surface, but to resist flexing in the direction of article advance in said path;

(e) said land portion being formed integrally with said main body; and (f) said load-exerting means exerting said load directly on the land portion.

2. A method according to claim 1, characterized in that said liquid coating material is a solvent-free coating material.

3. A method according to claim 2, characterized in that said solvent-free coating material is a molten polymer.

4. A coating head for continuously coating a major surface of a strip article (10) while the article is advancing longitudinally along a defined path, said coating head (20) having a die (28) defining an elongated slit (34), with an entry side and an exit side, for depositing a layer of liquid coating material on a facing major surface of a strip article (10) advancing along the path, a land portion (60) at the slit exit side and means for supplying liquid coating material to the slit (34); said coating head being characterized by:

(a) said land portion (60) having an extended land surface (30*a*) at the exit side of slit (34);

(b) means for supporting the die (28) with the slit (34) and land surface (30*a*) facing the path and the slit (34) extending transversely of the path such that during a coating operation a major surface of a strip article (10) advancing in the path past the slit (34) drags a layer of coating material from the slit, said supporting means permitting movement of the die (28) relative thereto in a direction normal to the path and to the slit (34);

(c) means for continuously exerting a load on at least the land portion (60) of the die during operation as aforesaid such that the layer of coating material deposited on the last-mentioned article (10) major surface is pressed between the land surface (30*a*) and the last-mentioned article (10) major surface to maintain the layer at a predetermined constant thickness while the layer alone holds the die (28) entirely away from contact with the last-mentioned article (10) major surface;

(d) said die (28) including a main body defining at least the entry side of the slit, and said land portion (60) being so connected to said main body as to be capable of flexing relative thereto in said normal direction but to resist flexing in the direction of article advance in said path;

(e) said land portion being formed integrally with said main body; and (f) said load-exerting means exerting said load directly on the land portion.

5. A coating head as defined in claim 4, characterized in that said land portion (60) is cantilevered with respect to said main body (28).

6. A coating head as defined in claim 4, characterized in that said land portion (60) is flexibly connected to said main body (28) on two opposed sides of said land portion.

7. A coating head as defined in claim 4, characterized in that said load-exerting means (48) comprises at least one piston (50) movable in said normal direction and means connected to said piston (50) for transmitting said load directly to said land portion (60), said last-mentioned means being interengageable with said main die body for permitting but limiting the extent of motion of the piston (50) and land portion (60) relative to said main body in said normal direction.

8. A coating head as defined in claim 7, characterized in that said land portion (60) has a second surface (60*a*) opposed to said land surface (30*a*), said transmitting means includes a chock (74) attached to said one piston (50), a rod (82) for load-transmitting engagement with said second surface of said land portion (60), and a projection (78) carried by said chock (74), and said main die body includes a socket (80) within which said projection (78) is received, said projection and socket being positioned and dimensioned to permit a limited extent of motion of said projection (78) within said recess in said normal direction.

9. A coating head as defined in claim 7, characterized in that said transmitting means comprises means for transmitting a force from said one piston (50) to said main die body (28) for moving said die relative to said supporting means in said normal direction.

10. A coating line for continuously coating a major surface of a strip article (10) while the article is advancing longitudinally along a defined path, including means for defining a path and direction of continuous longitudinal advance of a strip article (10) having a major surface to be coated; and a coating head (20) including a die (28) defining an elongated slit (34), with an entry side and an exit side, for depositing a layer of liquid coating material on a facing major surface of a strip article (10) advancing along the path, and having a land portion (60) at the slit exit side and means for supplying liquid coating material to the slit; characterized by:

(a) said land portion (60) having an extended land surface (30*a*) at the exit side of slit (34);

(b) means for supporting the die (28) with the slit (34) and land surface (30*a*) facing the path and the slit (34) extending transversely of the path such that during coating operation a major surface of a strip article (10) advancing in the path past the slit (34) drags a layer of coating material from the slit, said supporting means permitting movement of the die (28) relative thereto in a direction normal to the path and to the slit (34);

(c) means for continuously exerting a load on at least the land portion (60) of the die during operation as aforesaid such that the layer of coating material deposited on the last-mentioned article (10) major surface is pressed between the land surface **(30*a*) and the last-mentioned article (10) major surface to maintain the layer at a predetermined constant thickness while the layer alone holds the die (28) entirely away from contact with the last-mentioned article (10)** major surface;

(d) said die (28) including a main body defining at least the entry side of the slit, and said land portion (60) being so connected to said main body as to be capable of flexing relative thereto in said normal direction but to resist flexing in the direction of article advance in said path;

(e) said land portion being formed integrally with said main body; and (f) said load-exerting means exerting said load directly on the land portion.

11. A coating line as defined in claim 10, for continuous coating of an elongated strip article (10) having two opposed major surfaces to be coated, characterized in that said path includes a rectilinear portion in which said opposed surfaces are substantially planar, wherein said die-supporting means supports said die (28) at said rectilinear portion of said path such that during a coating operation said slit (34) faces one of the opposed major surfaces of a strip article advancing along said path; and further including a second coating head (22), disposed at said rectilinear path portion in opposed relation to said first-mentioned coating head, for depositing a layer of liquid coating material on the other of the opposed major surfaces of the last-mentioned strip article (10).

12. A coating line as defined in claim 10, for continuous coating of an elongated strip article (10) having two opposed major surfaces of which only one is to be coated, further characterized by means (562) for supporting said strip at a location in said path, said strip-supporting means (562) engaging the surface of said strip opposite said one surface at said location such that said one surface is exposed for coating at said location, and wherein said die-supporting means supports said die at said location such that during a coating operation said slit (34) faces said one surface of a strip article (10) advancing along said path, for depositing a layer of liquid coating material thereon.

* * * * *